US009058947B2

(12) United States Patent
Yaginuma et al.

(10) Patent No.: US 9,058,947 B2
(45) Date of Patent: Jun. 16, 2015

(54) PUFFER-TYPE GAS CIRCUIT-BREAKER

(71) Applicant: HITACHI, LTD., Tokyo (JP)

(72) Inventors: Noriyuki Yaginuma, Takahagi (JP); Masanori Tsukushi, Hitachi (JP); Makoto Hirose, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 197 days.

(21) Appl. No.: 13/728,332

(22) Filed: Dec. 27, 2012

(65) Prior Publication Data

US 2013/0168357 A1 Jul. 4, 2013

(30) Foreign Application Priority Data

Dec. 28, 2011 (JP) ..... 2011-290056

(51) Int. Cl.
*H01H 33/88* (2006.01)
*H01H 33/08* (2006.01)
*H01H 33/90* (2006.01)

(52) U.S. Cl.
CPC ..... *H01H 33/08* (2013.01); *H01H 33/901* (2013.01); *H01H 2033/906* (2013.01); *H01H 2033/908* (2013.01)

(58) Field of Classification Search
CPC .... H01H 33/00; H01H 33/08; H01H 33/7015
USPC ..... 218/57, 59, 61, 63, 68
See application file for complete search history.

(56) References Cited

U.S. PATENT DOCUMENTS 5,977,502 A * 11/1999 Mizoguchi et al. ..... 218/43
6,207,917 B1 * 3/2001 Lehmann et al. ..... 218/43
7,763,821 B2 * 7/2010 Yoshitomo et al. ..... 218/59
8,030,590 B2 * 10/2011 Yoshida et al. ..... 218/61
2010/0147804 A1 * 6/2010 Yamada et al. ..... 218/63

FOREIGN PATENT DOCUMENTS

JP 01-313827 A 12/1989
JP 2003-141974 A 5/2003

OTHER PUBLICATIONS

Machine Translation attached for JP 2003-141974 cited in Office Action.*

* cited by examiner

*Primary Examiner* — Renee S Luebke
*Assistant Examiner* — William Bolton
(74) *Attorney, Agent, or Firm* — Mattingly & Malur, PC

(57) ABSTRACT

A puffer-type gas circuit-breaker having improved interruption performance and dielectric performance, comprising: a partition wall provided in a stationary cylinder on the moving side of the circuit-breaker to form an intra-stationary cylinder space, a mechanical puffer chamber provided adjacent to one flange of the partition wall and a hot gas exhaust chamber provided on the same side as another flange of the partition wall, wherein the stationary cylinder has gas inlet holes communicated with the intra-stationary cylinder space and formed on one side relative to a virtual plane that bisects the stationary cylinder in a radial direction, gas outlet holes communicated with the intra-stationary cylinder space, and hot gas exhaust openings communicated with the hot gas exhaust chamber, further communicated with the puffer shaft flow hole after an arc is generated and formed in radial directions of the stationary cylinder and on the other side relative to the virtual plane.

5 Claims, 5 Drawing Sheets

PUFFER-TYPE GAS CIRCUIT-BREAKER

CLAIM OF PRIORITY

The present application claims priority from Japanese Patent application serial No. 2011-290056, filed on Dec. 28, 2011, the content of which is hereby incorporated by reference into this application.

TECHNICAL FIELD

The present invention relates to a puffer-type gas circuit-breaker, and more particularly to the exhaust structure of a puffer-type gas circuit-breaker.

Background Art

A gas circuit-breaker practically used in a high-voltage electric power transmission network uses both a gas circuit-breaker of mechanical puffer chamber type, which compresses a dielectric gas in an enclosure tank with a mechanical force and blasts arcs generated between contacts with the compressed dielectric gas to interrupt the arcs, and a gas circuit-breaker of thermal puffer chamber type (self-blast chamber type), which uses arc energy generated between contacts to blast arcs with a dielectric gas.

In the puffer-type gas circuit-breaker, it is important to improve interruption performance and dielectric performance. A technique related to a puffer-type gas circuit-breaker aimed at improving interruption performance is disclosed in PTL 1 (Japanese Patent Laid-open No. Hei 1 (1989)-313827). In this technique, as shown in FIG. 9, a partition wall 270, which extends inwardly and has a sliding contact with the outer circumferential surface of a hollow rod 160 in a sleeve shape, is provided in an opening of a puffer cylinder 100 thereby forming an inlet chamber 260 between the partition wall 270 and a piston 170. In order to introduce a dielectric gas outside the puffer cylinder 100 into a puffer chamber 90 through the inlet chamber 260, inlet holes 280 are formed in the puffer cylinder 100, and the piston 170 is provided with a plurality of communication holes 240 and a plurality of check valves 250 so that the dielectric gas flows from the inlet chamber 260 only into the puffer chamber 90. In the opening of the puffer cylinder 100, a separating skirt 290, which is broadened toward its end, is formed integrally with the puffer cylinder 100 to prevent the dielectric gas exhausted from an outlet hole 150 through a communication hole 60 from being directly inhaled from the inlet holes 280 into the puffer chamber 90.

CITATION LIST

Patent Literature

[PTL 1] Japanese Patent Laid-open No. Hei 1 (1989)-313827

SUMMARY OF INVENTION

Technical Problem

The circuit-breaker according to this technique is structured so that a high-temperature and high-pressure gas including conductive materials generated through arc quenching is not easily inhaled from the inlet holes 280. Accordingly, it is possible to supply a dielectric gas with a low impurity density into the puffer chamber 90, enabling interruption performance to be favorably maintained. In this structure, however, the high-temperature and high-pressure gas including conductive materials generated through arc quenching may flow toward an insulating support member (not shown), by which a moving-side conductor is fixed on the right side on the drawing sheet. Therefore, there has been a risk that if the insulating support member is blasted with the high-temperature and high-pressure gas including conductive materials, the dielectric performance of the breaker may be adversely affected.

An object of the present invention is to provide a gas circuit-breaker that not only solves the above problem with the dielectric performance but also improves the interruption performance. Specifically, an object of the present invention is to improve the dielectric performance by preventing the insulating support member from being directly blasted with a high-temperature and high-pressure gas including conductive materials generated through arc quenching, the insulating support member being a weak point in terms of insulation of the circuit breaker, and to improve the interruption performance by supplying a dielectric gas with a low impurity density into a puffer chamber.

Solution to Problem

The puffer-type gas circuit-breaker according to the present invention includes an enclosure tank filled with a dielectric gas; a stationary cylinder, on a moving side, that is held in the enclosure tank by an insulating support tube and is connected to a current conductor; a puffer shaft, in a hollow shape, that is provided in the stationary cylinder so as to be coaxial with the stationary cylinder, one end of the puffer shaft being linked to an insulating rod linked to an operating device, the puffer shaft having a puffer shaft flow hole through which a high-temperature and high-pressure gas generated at the time of arc generation is exhausted; a moving puffer piston that is connected to the other end of the puffer shaft so as to be coaxial with the puffer shaft, the moving puffer piston being movable in the stationary cylinder in an axial direction thereof; a moving arc contact, an insulating nozzle, and a moving main contact that are provided at an end of the moving puffer piston so as to be mutually concentric from an inner side; a partition wall secured to the inner circumference of the stationary cylinder, the partition wall having a guide member through which the puffer shaft slidably passes; and a stationary-side stationary cylinder having a stationary arc contact and a stationary main contact at one end, the stationary arc contact and stationary main contact being disposed opposite to the moving arc contact and moving main contact. In this structure, the partition wall has flanges at both ends, the flanges being secured to the stationary cylinder so as to form a space in the stationary cylinder, one flange of the partition wall has an inlet hole and an outlet hole, the one flange of the partition wall forms a mechanical puffer chamber together with the moving puffer piston, the stationary cylinder, and the puffer shaft, the other flange of the partition wall forms a hot gas exhaust chamber together with the stationary cylinder, the stationary cylinder has a hole used for gas inhaling and a hole used for gas expelling, the holes communicating with the space in the stationary cylinder, and also has a hot gas exhaust opening that communicates with the hot gas exhaust chamber, the hot gas exhaust opening is formed in radial direction of the stationary cylinder and communicates with the puffer shaft flow hole after an arc is generated, the hole used for gas inhaling is formed on one side relative to a virtual plane that bisects the stationary cylinder in a radial direction, and the hot gas exhaust opening is formed on the other side relative to the virtual plane.

The partition wall preferably has a dividing member that divides the space in the stationary cylinder into two parts to divide the space in the stationary cylinder into an inhaling space that communicates with the hole used for gas inhaling and an expelling space that communicates the hole used for gas expelling; the hole used for gas inhaling is preferably formed on the same side as the inhaling space and the hole used for gas expelling is preferably formed on the same side as the expelling space.

When the stationary cylinder is divided into two parts with the virtual plane that is orthogonal to the current conductor and bisects the stationary cylinder in a radial direction, the hot gas exhaust opening is preferably disposed opposite to a side on which the current conductor is disposed.

Advantageous Effects of Invention

Because a high-temperature and high-pressure gas generated from an arc space at the time of arc generation is exhausted to a place distant from an insulating support tube and a moving-side current conductor, it becomes possible to prevent a ground fault and improve dielectric performance. In addition, since the high-temperature and high-pressure gas generated at the time of arc generation is prevented from entering a thermal puffer chamber, a dielectric gas with a low impurity density can be supplied to arcs and thereby interruption performance can also be improved.

DESCRIPTION OF EMBODIMENTS

Figure 1:
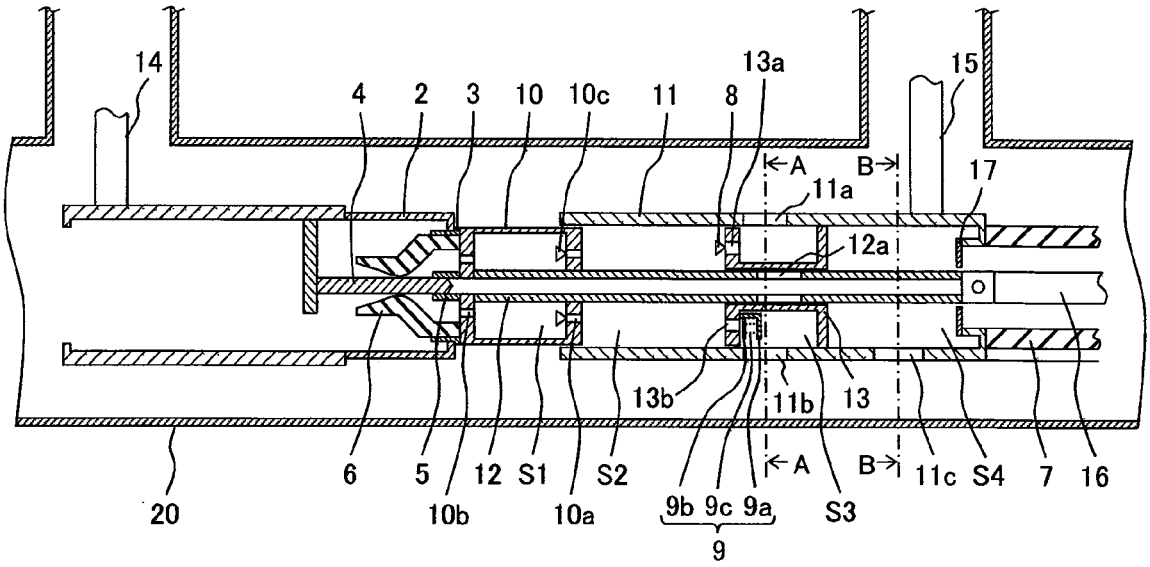
FIG. 1 is a cross sectional view of a puffer-type gas circuit-breaker, in a first embodiment of the present invention, which is at a closed position.

A puffer-type gas circuit-breaker in the present invention will be described below with reference to the drawing.

Example 1

FIG. 1 is a cross sectional view of a puffer-type gas circuit-breaker in the present invention, which is at a closed position. A stationary main contact 2 and a moving main contact 3, which are both annular, are provided in an enclosure tank 20 filled with a dielectric gas such as a sulfur hexafluoride ($SF_6$) gas so as to face each other on the same axis. A stationary arc contact 4 is provided inside the stationary main contact 2 so as to be concentric with it. A moving arc contact 5 is provided inside the moving main contact 3 so as to be concentric with it.

The stationary main contact 2 and the stationary arc contact 4 are electrically connected to a stationary-side current conductor 14. The moving main contact 3 and the moving arc contact 5 are electrically connected to a moving-side current conductor 15 through a moving puffer piston 10 and a stationary cylinder 11 on a moving side (moving-side stationary cylinder).

A thermal puffer chamber (self-blast chamber) S1 is formed with a space enclosed by the moving puffer piston 10 and a puffer shaft 12, which is hollow. An inlet hole 10*a*, which communicates with a mechanical puffer chamber S2 in the puffer piston 10, is provided with a check valve 10*c*. The check valve 10*c* restricts a gas flow from the thermal puffer chamber S1 into the mechanical puffer chamber S2 but does not restrict a gas flow from the mechanical puffer chamber S2 to the thermal puffer chamber S1.

An insulating nozzle 6 is provided between the moving main contact 3 and moving arc contact 5 so as to be concentric with them. The insulating nozzle 6 is structured so that the dielectric gas in the thermal puffer chamber S1, which is exhausted through an outlet hole 10*b*, is blown to arcs generated in a space formed between the stationary arc contact 4 and the moving arc contact 5 (the space will be referred to below as the arc space).

The moving arc contact 5 is disposed at one end of the puffer piston 10. A space enclosed by the other end of the puffer piston 10, the moving-side stationary cylinder 11, the puffer shaft 12, and a partition wall 13 forms the mechanical puffer chamber S2. The puffer piston 10 can reciprocate in the mechanical puffer chamber S2 in the axial direction, by which an opening operation and a closing operation can be carried out.

One end of the puffer shaft 12 is secured to the one end of the puffer piston 10 so as to be concentrically disposed inside the puffer piston 10. The other end of the puffer shaft 12 is linked to an insulating operating rod 16. The insulating operating rod 16 is linked to an operating device (not shown). Due to this structure, the driving force of the operating device (not shown) is transmitted to the puffer piston 10.

The moving-side stationary cylinder 11 is secured to the interior of the enclosure tank 20 by an insulating support tube 7. The moving-side stationary cylinder 11 has gas inlet holes 11*a*, gas outlet holes 11*b*, and hot gas exhaust openings 11*c*. The partition wall 13 is provided on the inner circumference of the moving-side stationary cylinder 11 so as to slidably hold the puffer shaft 12.

The partition wall 13, which is cylindrical, has flanges at both ends. The flanges are fitted to the inner circumference of the moving-side stationary cylinder 11 and are attached to the moving-side stationary cylinder 11 with screws or the like. A sliding member (not shown) such as a piston ring is provided at an arbitrary position on the inner surface of the partition wall 13 thereby the puffer shaft 12 slides on the inner surface of the partition wall 13 while maintaining a hermetic seal in the mechanical puffer chamber S2.

Figure 2:
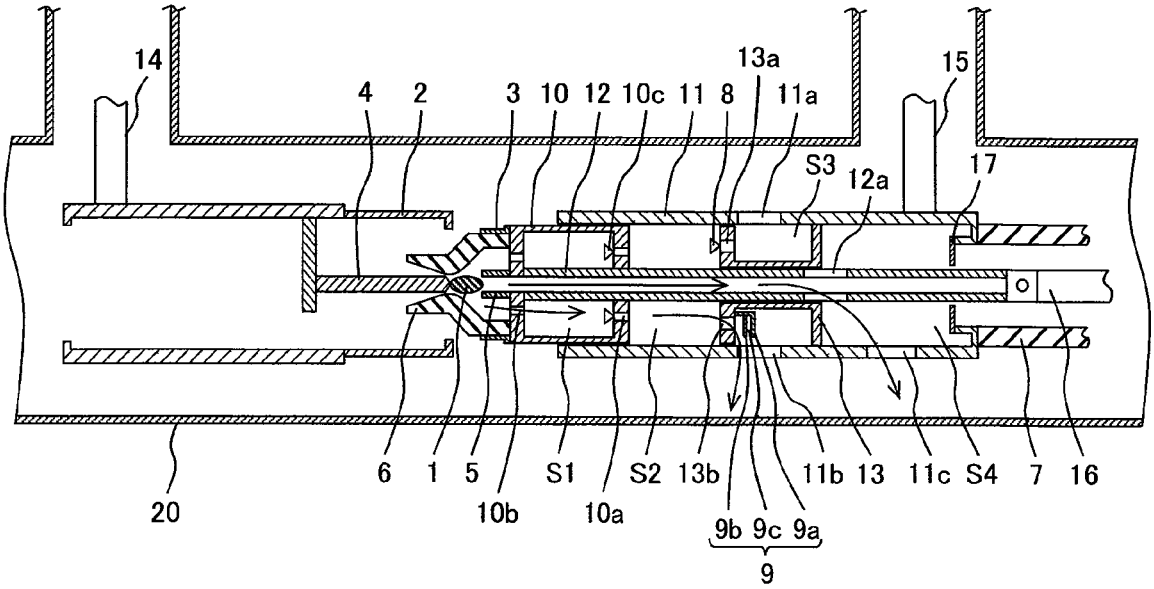
FIG. 2 is a cross sectional view of the puffer-type gas circuit-breaker, in the first embodiment of the present invention, in a state in which the puffer-type gas circuit-breaker is being opened at the time of arc generation.

The puffer shaft 12, which is hollow, has a shaft outlet hole 12*a*. The shaft outlet hole 12*a* is formed as shown in FIG. 2 so as to communicate with a hot gas exhaust chamber S4 after arcs have been generated. The hot gas exhaust chamber S4 is formed with the partition wall 13, the moving-side stationary cylinder 11, and a shield 17.

The shield 17 is configured to minimize the clearance between the puffer shaft 12 and the shield 17 within a range in which the puffer shaft 12, which moves in the axial direction, does not come into contact with the shield 17, minimizing an amount of the high-temperature and high-pressure gas, which is exhausted through the shaft outlet hole 12*a* into the hot gas exhaust chamber S4, flowing into the insulating support tube 7. Thus, the high-temperature and high-pressure gas generated in the arc space can be exhausted through the hot gas exhaust openings 11*c* of the hot gas exhaust chamber S4. To prevent the exhausted high-temperature and high-pressure gas from flowing toward the insulating support tube 7 as much as possible, the hot gas exhaust openings 11*c* are formed so that the gas is exhausted in radial directions.

The partition wall 13 has inlet holes 13*a* and outlet holes 13*b*, each of which has a check valve 8 and a release valve 9. The release valve 9 is a check valve for outgoing chamber gas. The release valve 9 is formed with, for example, a spring support member 9*a*, a spring biased valve 9*b*, and a release pressure spring 9*c* having a prescribed elastic coefficient. The release valve 9 is configured to release the pressure from the mechanical puffer chamber S2 when the pressure reaches a threshold level, thereby coordinating the exhaust of the gas in the mechanical puffer chamber S2.

Figure 5:
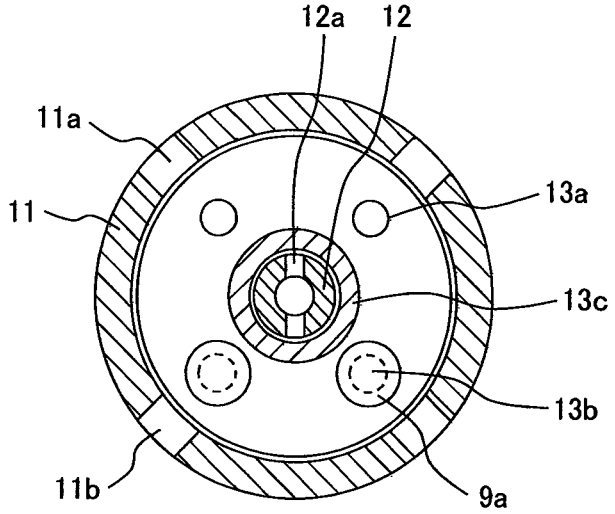
FIG. 5 is a cross sectional view as taken along line A-A in FIG. 1.

As shown in FIG. 5, the gas inlet holes 11*a*, through which the dielectric gas is inhaled from the enclosure tank, are formed in the vicinity of the inlet holes 13*a* of the moving-side stationary cylinder 11, and the gas outlet holes 11*b*, through which the dielectric gas is exhausted from the mechanical puffer chamber S2 into the enclosure tank, are formed in the vicinity of the outlet holes 13*b*.

Figure 6:
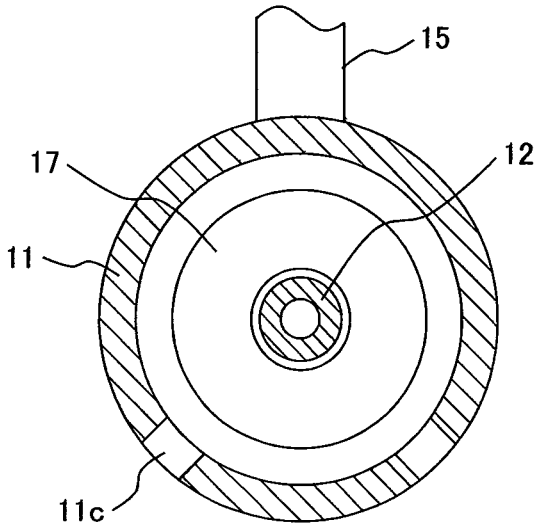
FIG. 6 is a cross sectional view as taken along line B-B in FIG. 1.

FIG. 6 shows the positional relationship between the moving-side current conductor 15 and the hot gas exhaust openings 11*c*. The gas exhausted from the arc space through the puffer shaft 12 and the hot gas exhaust openings 11*c* is a high-temperature gas with a low density. Accordingly, when the hot gas is directly blown to the current conductor, a ground fault or the like may be caused. In the present invention, to prevent the high-temperature and high-pressure gas from being directly blown to the current conductor, the hot gas exhaust openings 11*c* are disposed at a distance from the moving-side current conductor 15 to improve the dielectric performance of the circuit breaker. Particularly, when the moving-side stationary cylinder 11 is divided into two parts with a virtual plane that is orthogonal to the moving-side current conductor 15 and bisects the moving-side stationary cylinder 11 in a radial direction, the hot gas exhaust openings 11*c* are preferably disposed opposite to a side on which the moving-side current conductor 15 is disposed.

The number of gas inlet holes 11*a*, gas outlet holes 11*b*, and hot gas exhaust openings 11*c*, which are disposed in the moving-side stationary cylinder 11, their shapes, and their positions can be appropriately changed. To reduce the risk of the high-temperature and high-pressure gas exhausted through the hot gas exhaust openings 11*c* from flowing into the gas inlet holes 11*a*, the gas inlet holes 11*a* are preferably formed on one side relative to the virtual plane that bisects the moving-side stationary cylinder 11 in a radial direction, and the hot gas exhaust openings 11*c* are preferably formed on the other side relative to the virtual plane. In this structure, the gas inlet holes 11*a* and the hot gas exhaust openings 11*c* are configured so that the gas inlet holes 11*a* and the hot gas exhaust openings 11*c* are separated from each other as much as possible. Thus, a dielectric gas with a low impurity density is always supplied into the thermal puffer chamber S1, so the interruption performance of the circuit breaker can be improved.

As described above, the present invention can improve the dielectric performance of the circuit breaker by exhausting the high-temperature and high-pressure gas, generated at the time of arc generation, from the arc space to a place distant from the insulating support tube 7 and moving-side current conductor 15. The present invention can also improve the interruption performance of the circuit breaker by preventing the high-temperature and high-pressure gas generated at the time of arc generation from flowing into the mechanical puffer chamber S2 and thermal puffer chamber S1 and by supplying a dielectric gas with a low impurity density to arcs. These improvements can be achieved with the structures shown in FIGS. 1, 5, and 6, and thereby the reliability of the circuit breaker can be improved.

The opening operation of the puffer-type gas circuit-breaker according to the present invention will be described with reference to FIGS. 1 to 4. The flow of the dielectric gas generated by the opening operation is also described. When the puffer-type gas circuit-breaker in the closed position shown in FIG. 1 starts an opening operation, the insulating operating rod 16 moves to the right on the drawing sheet due to the driving force of the operating device (not shown) and the puffer-type gas circuit-breaker enters the state, shown in FIG. 2, at the time of arc generation.

In this state, the shaft outlet hole 12*a* communicates with the hot gas exhaust chamber S4 as described above. The high-temperature and high-pressure gas, in which conductive materials generated in the arc space have been melted, passes through the hollow interior of the puffer shaft 12 and is exhausted through the shaft outlet hole 12*a* into the hot gas exhaust chamber S4. The high-temperature and high-pressure gas is further exhausted through the hot gas exhaust openings 11*c* into the interior of the enclosure tank in radial directions of the moving-side stationary cylinder 11. Since the hot gas exhaust openings 11*c* are formed at positions distant from the gas inlet holes 11*a* as far as possible as described above, the high-temperature, high-pressure gas generated in the arc space are exhausted to a place distant from the gas inlet holes 11*a* as far as possible.

When the opening operation proceeds from the state in FIG. 2, one of two opening operations is carried out depending on the interrupting current. In case of interrupting high current, the pressure in the thermal puffer chamber S1 is increased by arc energy and thereby the check valve 10*c* is closed. When the pressure in the mechanical puffer chamber S2 is increased, the release valve 9 is opened. Then, the gas in the mechanical puffer chamber S2 is released through the gas outlet holes 11*b* into the enclosure tank. At the same time, the high-pressure gas in the thermal puffer chamber S1 is blown to an arc 1 and quenches the arc 1 thereby obtaining current interruption.

By contrast, in case of interrupting low current, even if the moving puffer piston 10 is moved to the right on the drawing sheet, the pressure in the arc space is not so increased by the arc 1 when compared with the case of interrupting high current, so the pressure in the thermal puffer chamber S1 is not so high when compared with the case of interrupting high current. Accordingly, the release valve 9 is not positively opened and the check valve 10*c* is opened instead. Then, the dielectric gas in the mechanical puffer chamber S2 is blown to the arc 1 through the thermal puffer chamber S1 and the arc 1 is thereby quenched.

Figure 3:
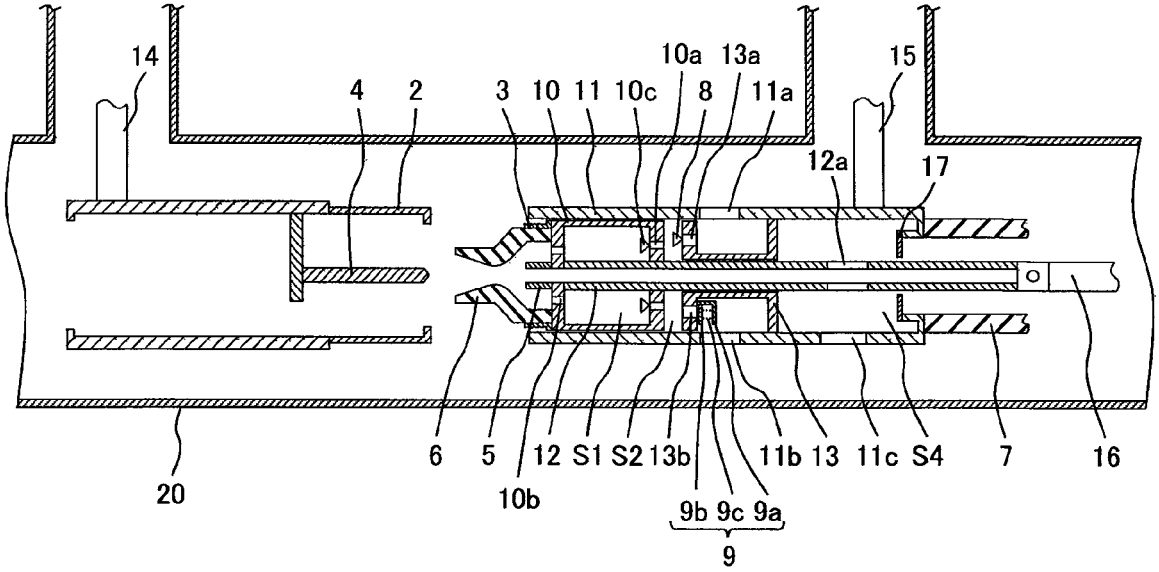
FIG. 3 is a cross sectional view of the puffer-type gas circuit-breaker, in the first embodiment of the present invention, in a state in which the puffer-type gas circuit-breaker has been opened.

When the opening operation further proceeds, the puffer-type gas circuit-breaker enters a completely open state shown in FIG. 3. At that time, the moving puffer piston 10 has moved as far to the right on the drawing sheet as possible, and the volume of the mechanical puffer chamber S2 is minimized. If a closing command is issued in this state, the puffer-type gas circuit-breaker enters a state in which a closing operation is in progress shown in FIG. 4 and then enters a completely closed state shown in FIG. 1.

Figure 4:
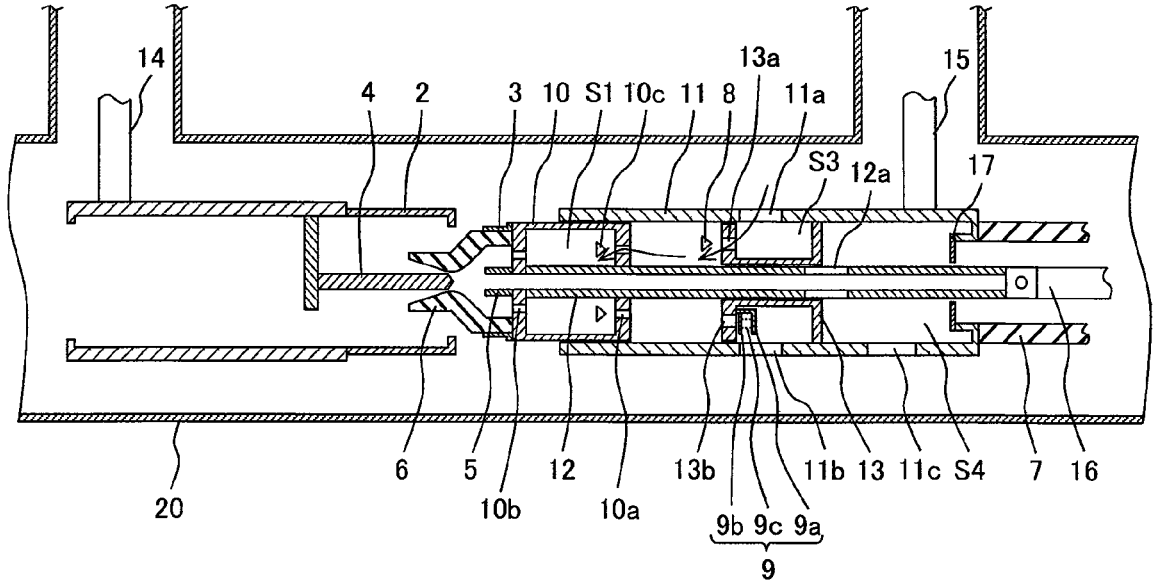
FIG. 4 is a cross sectional view of the puffer-type gas circuit-breaker, in the first embodiment of the present invention, in a state in which the puffer-type gas circuit-breaker is being closed.

In the state in which a closing operation is in progress shown in FIG. 4, the moving puffer piston 10 moves to the left on the drawing sheet, so the volume of the mechanical puffer chamber S2 is gradually increased. Since the pressure in the mechanical puffer chamber S2 is gradually decreased at that time, the dielectric gas in the enclosure tank flows through the gas inlet holes 11*a* into an intra-stationary cylinder space S3. Since the gas inlet holes 11*a* are formed at positions distant from the hot gas exhaust openings 11*c*, the gas in the vicinity of the gas inlet holes 11*a* can have a low density of conductive foreign materials melted by arcs and exhausted through the hot gas exhaust openings 11*c*. Accordingly, a dielectric gas with a low impurity density flows from the gas inlet holes 11*a* into the thermal puffer chamber S1 through the inlet holes 13*a* and the mechanical puffer chamber S2. Thus, the interruption performance can be improved. This is particularly effective to maintain superior interruption performance at the time of high-speed reclosing in which only one second is allowed to complete a re-closing operation from when the circuit breaker was opened due to an accident. If the gas inlet holes 11*a* and hot gas exhaust openings 11*c* are adjacently formed, the high-temperature and high-pressure dielectric gas exhausted through the hot gas exhaust openings 11*c* at the time of high-speed reclosing remains in the vicinity of the gas inlet holes 11*a* and is inhaled through the gas inlet holes 11*a*, lowering interruption performance.

With the structure (see FIGS. 4 to 6) described above in which the hot gas exhaust openings 11*c* are formed at positions distant from the moving-side current conductor 15 and the high-temperature and high-pressure gas is exhausted through the hot gas exhaust openings 11*c* in radial directions of the moving-side stationary cylinder 11, it is possible to prevent the high-temperature and high-pressure gas from being directly blown to the insulating support tube 7 and the moving-side current conductor 15. This reduces the risk that conductive foreign materials included in the high-temperature and high-pressure gas are attached to the insulating support tube 7, making it possible to further improve the dielectric performance of the circuit breaker. When the high-temperature dielectric gas with a low density, which has low dielectric performance, is directly blown to the moving-side current conductor 15, insulation between the moving-side current conductor 15 and an angular part, where the moving-side current conductor 15 is drawn, of the enclosure tank may be deteriorated. If it is prevented to directly blow the gas to the moving-side current conductor 15, however, the dielectric performance of the circuit breaker can be further improved.

Figure 7:
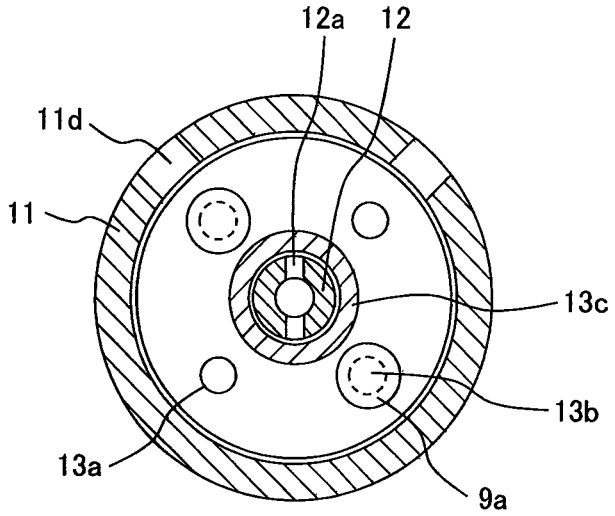
FIG. 7 is a variation of the first embodiment of the present invention.

The partition wall 13 may be structured as shown in FIG. 7. The structure in FIG. 7 differs in that gas inlet/outlet holes 11*d* formed in the moving-side stationary cylinder 11 double as the gas inlet holes 11*a* and the gas outlet holes 11*b* shown in FIG. 5.

In the structure shown in FIG. 7, there are no holes on the lower side on the drawing sheet, so it is possible to reduce the risk that the high-temperature and high-pressure gas including conductive foreign materials, which is exhausted through the hot gas exhaust openings 11*c* toward the lower side on the drawing sheet, may enter the intra-stationary cylinder space S3. Thus, a dielectric gas with a low impurity density flows from the gas inlet/outlet holes 11*d* in FIG. 7 into the thermal puffer chamber S1, and it is possible to maintain a more preferable interruption performance.

Example 2

A second embodiment of the present invention will be described with reference to FIG. 8. The same elements as in the first embodiments are denoted by the same reference characters and repeated descriptions will be omitted. The second embodiment is characterized in that the partition wall 13 has partitioning members 13*d* to divide the intra-stationary cylinder space S3, into an inlet-side space S3*a* and an outlet-side space S3*b*.

At one end of the partitioning members 13*d*, a guide 13*c* is provided so that the hollow puffer shaft 12 slides in the axial direction. The gas inlet holes 11*a* and inlet holes 13*a* are formed on the upper side (inlet-side space S3*a*), on the drawing sheet, of the partitioning member 13*d*. The gas outlet holes 11*b* and the outlet holes 13*b* are formed on the lower side (outlet-side space S3*b*), on the drawing sheet, of the partitioning member 13*d*.

Figure 8:
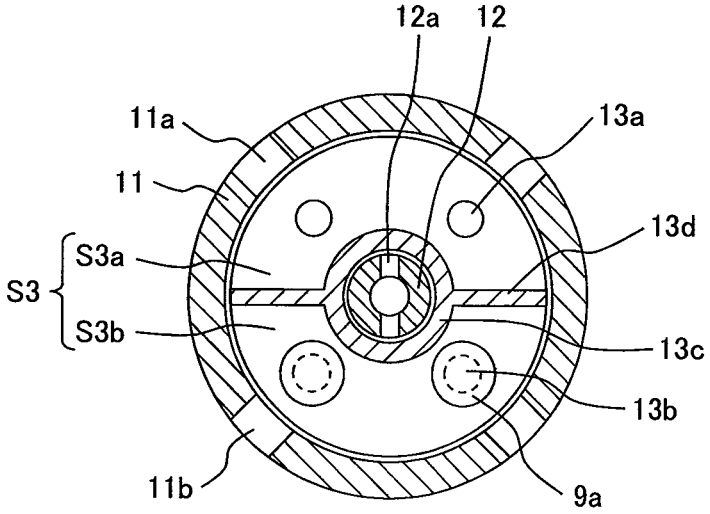
FIG. 8 is a cross sectional view of the second embodiment of the present invention.
Figure 9:
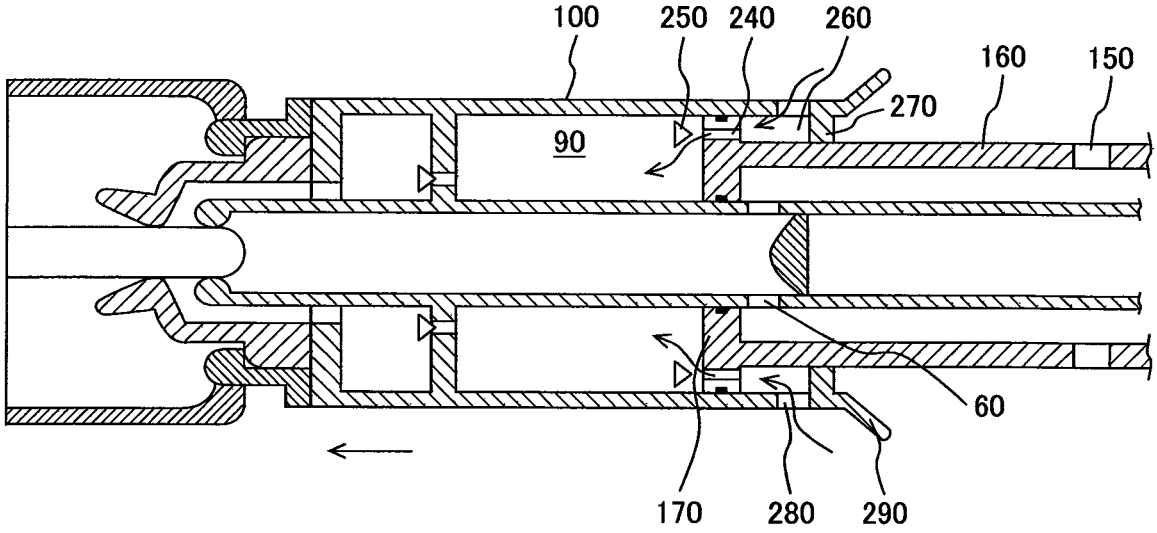
FIG. 9 PRIOR ART
FIG. 9 is a cross sectional view of a conventional puffer-type gas circuit-breaker at a closed position.

Although, in the embodiment shown in FIG. 8, the partitioning members 13*d* are formed in the same plane with the guide 13*c* therebetween so as to bisect the intra-stationary cylinder space S3, this is not a limitation. The ratio between the volume of the inlet-side space S3*a* and the volume of the outlet-side space S3*b* can be appropriately changed according to the design.

In this embodiment, the moving-side current conductor 15 is drawn upward on the drawing sheet. In view of the positions of the gas inlet holes 11*a* and the hot gas exhaust openings 11*c*, therefore, the partitioning members 13*d* are structured so as to divide the intra-stationary cylinder space S3 into an upper part and a lower part. However, this is not a limitation; if the moving-side current conductor 15 is drawn in the horizontal direction on the drawing sheet, the partitioning members 13*d* may be structured so as to divide the intra-stationary cylinder space S3 into a right part and a left part. That is, the structure of the partitioning member 13*d* can be appropriately changed according to the direction in which the moving-side current conductor 15 is drawn.

With the structure described above, even if the high-temperature and high-pressure gas exhausted through the hot gas exhaust openings 11*c* flows through the gas outlet holes 11*b* into the outlet-side space S3*b*, the partitioning members 13*d* blocks the flow of the gas. Accordingly, it becomes possible to prevent the gas from flowing into the inlet-side space S3*a*, in which the inlet holes 13*a* are formed. This prevents the high-temperature and high-pressure gas from flowing into the thermal puffer chamber S1, so interruption performance can be further improved.

REFERENCE SIGNS LIST

1 arc
2 stationary main contact
3 moving main contact
4 stationary arc contact
5 moving arc contact
6 insulating nozzle
7 insulating support tube
8 check valve
9 release valve
10 moving puffer piston
10*a* inlet hole
11 stationary cylinder (moving-side stationary cylinder)
11*a* gas inlet hole

11*b* gas outlet hole
11*c* hot gas exhaust opening
11*d* gas inlet/outlet hole
11 puffer shaft
12 partition wall
13*a* inlet hole
13*b* outlet hole
13*c* guide
13*d* partitioning member
14 stationary-side current conductor
15 moving-side current conductor
16 insulating operating rod
17 shield
20 enclosure tank (gastight enclosure)
S1 thermal puffer chamber
S2 mechanical puffer chamber
S3 intra-stationary cylinder space
S3*a* inlet-side space
S3*b* outlet-side space
S4 hot gas exhaust chamber

The invention claimed is:

1. A puffer-type gas circuit-breaker comprising:

an enclosure tank filled with a dielectric gas;

a stationary cylinder that is held in the enclosure tank by an insulating support tube and is connected to a first current conductor;

a hollow puffer shaft that is disposed coaxially in the stationary cylinder, one end of the puffer shaft linked to an insulating operating rod, the puffer shaft having a puffer shaft flow hole through which a high-temperature and high-pressure gas generated is exhausted when an arc is generated;

a puffer piston that is connected to another end of the puffer shaft so as to be coaxial with the puffer shaft, the puffer shaft and the puffer piston movable in the stationary cylinder in an axial direction thereof;

a moving arc contact;

an insulating nozzle;

a moving main contact, the moving arc contact, the insulating nozzle, and the moving main contact provided at an end of the moving puffer piston so as to be mutually concentric from an inner side;

a partition wall secured to an inner circumference of the stationary cylinder, the partition wall having a guide member through which the puffer shaft slidably moves; and a stationary arc contact and a stationary main contact, the stationary arc contact and stationary main contact connected to a second current conductor, and disposed opposite to the moving arc contact and moving main contact in the enclosure tank, wherein:

the partition wall has flanges at both ends, the flanges secured to the stationary cylinder so as to form a space in the stationary cylinder, one of the flanges of the partition wall has an inlet hole and an outlet hole, and a mechanical puffer chamber is formed with the one of the flanges, the puffer piston, the stationary cylinder, and the puffer shaft, the stationary cylinder has a gas inhaling hole and a gas expelling hole, each communicating between the space in the stationary cylinder and the enclosure tank, another of the flanges of the partition wall is disposed with the gas inhaling hole between the one of the flanges and the other of the flanges, and a hot gas exhaust chamber is formed with the other of the flanges and the stationary cylinder, the stationary cylinder also has a hot gas exhaust opening communicating between the puffer shaft flow hole via the hot gas exhaust chamber and the enclosure tank after the arc is generated, the hot gas exhaust opening is formed in a radial direction of the stationary cylinder, and the gas inhaling hole is formed on one side of the stationary cylinder in the radial direction, and the hot gas exhaust opening is formed on an opposing side of the stationary cylinder in the radial direction.

2. The puffer-type gas circuit-breaker according to claim 1, wherein:

the partition wall has a dividing member that divides the space in the stationary cylinder into two parts to divide the space in the stationary cylinder into an inhaling space that communicates with the gas inhaling hole and an expelling space that communicates the gas expelling hole; and the gas inhaling hole is formed on a same side of the partition wall as the inhaling space and the gas expelling hole is formed on the same side as the expelling space.

3. The puffer-type gas circuit-breaker according to claim 1, wherein the hot gas exhaust opening is disposed opposite to a side of the stationary cylinder on which the first current conductor is disposed in the radial direction.

4. The puffer-type gas circuit-breaker according to claim 2, wherein the hot gas exhaust opening is disposed opposite to a side of the stationary cylinder on which the first current conductor is disposed in the radial direction.

5. The puffer-type gas circuit-breaker according to claim 1, wherein the puffer shaft moves relative to the partition wall when the arc is generated so that the puffer shaft flow hole is brought into communication with the hot gas exhaust opening.

* * * * *